United States Patent [19]

Schmidt et al.

[11] Patent Number: 4,978,144

[45] Date of Patent: Dec. 18, 1990

[54] AIRLINE LUGGAGE TAG AND JACKET THEREFOR AND METHOD OF USE

[75] Inventors: Eric Schmidt, Elgin; John R. Poplawski, Darien, both of Ill.

[73] Assignee: Wallace Computer Services, Inc., Hillside, Ill.

[21] Appl. No.: 451,780

[22] Filed: Dec. 18, 1989

[51] Int. Cl.[5] ..... B42D 15/00

[52] U.S. Cl. ..... 283/70; 283/23; 283/99; 283/100; 283/103

[58] Field of Search ..... 40/6, 638; 283/70, 80, 283/81, 100, 103, 104, 105, 108, 23, 24, 25, 26, 27, 28, 29, 98, 99; 281/2, 5, 28, 12, 51

[56] References Cited

U.S. PATENT DOCUMENTS

| | | | |
|---|---|---|---|
| 1,384,457 | 7/1921 | Fetters | 40/6 |
| 3,583,317 | 6/1971 | Gibson | 283/98 |
| 3,788,540 | 2/1972 | Sammons | 40/6 |
| 4,042,171 | 8/1977 | Ross et al. | 40/6 |
| 4,631,845 | 12/1986 | Samuel et al. | 40/6 |
| 4,936,605 | 6/1990 | Kifer | 282/12 R |

*Primary Examiner*—Frank T. Yost
*Assistant Examiner*—Thomas Hamill, Jr.
*Attorney, Agent, or Firm*—Tilton, Fallon, Lungmus and Chestnut

[57] ABSTRACT

An airline luggage tag and jacket therefor and method wherein a central claim check is removable leaving a generally U-shaped remainder, this U-shaped remainder having arm portions that are equipped with slits for capturing the remainder of the tag when the tag is looped around the handle of a piece of luggage, the check having transversely extending ears for insertion into slits in the jacket.

14 Claims, 2 Drawing Sheets

FIG. 1
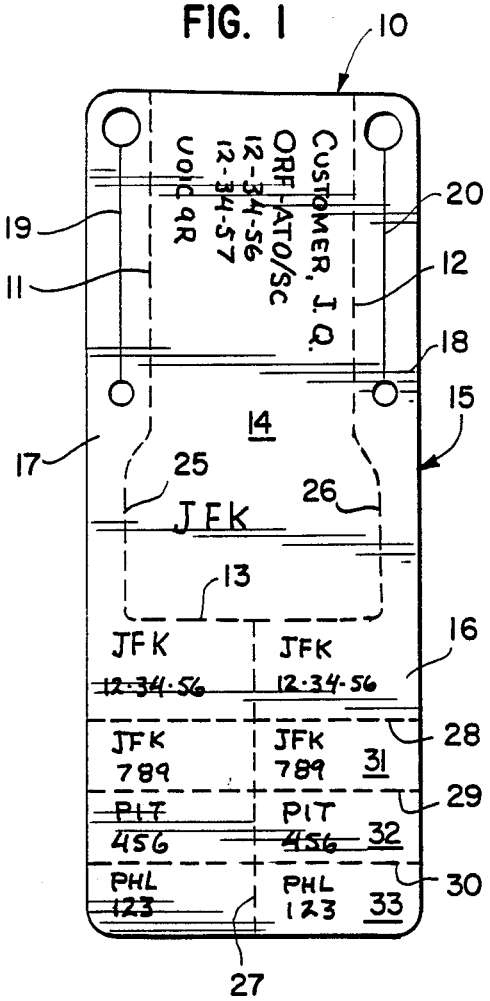
FIG. 2
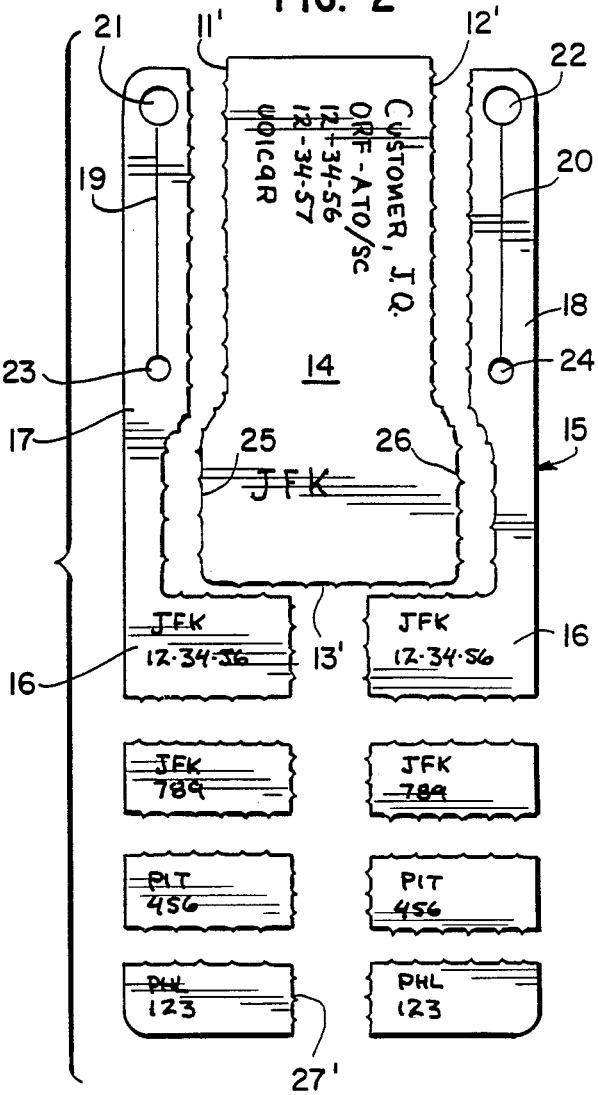
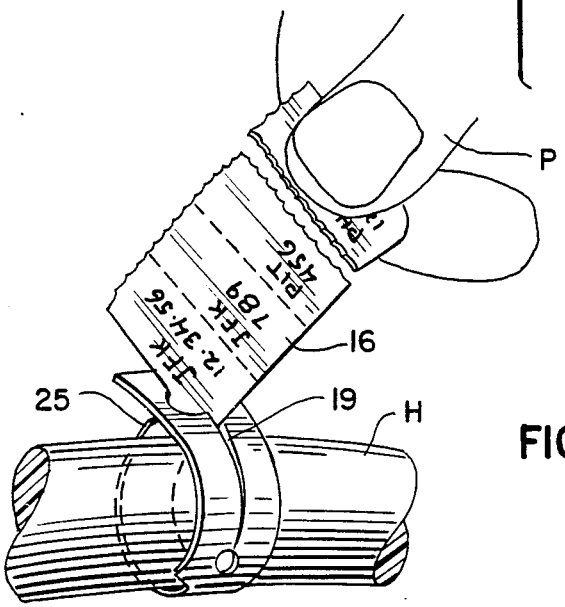
FIG. 3

FIG. 4
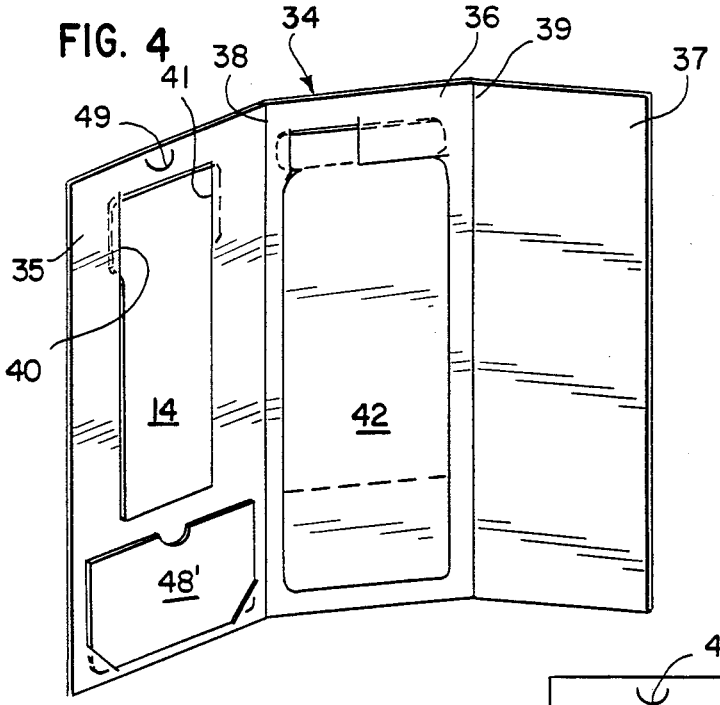
FIG. 8
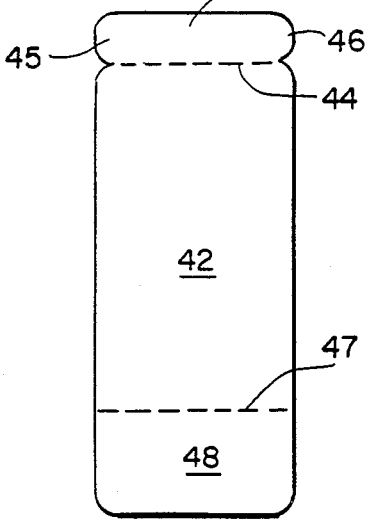
FIG. 6
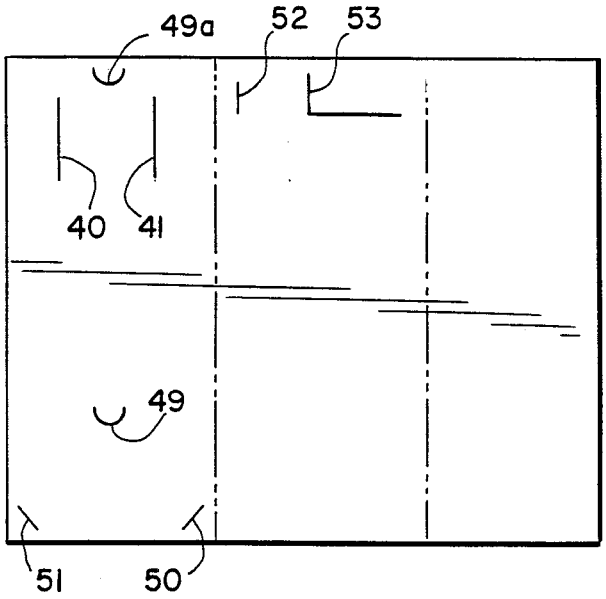
FIG. 5
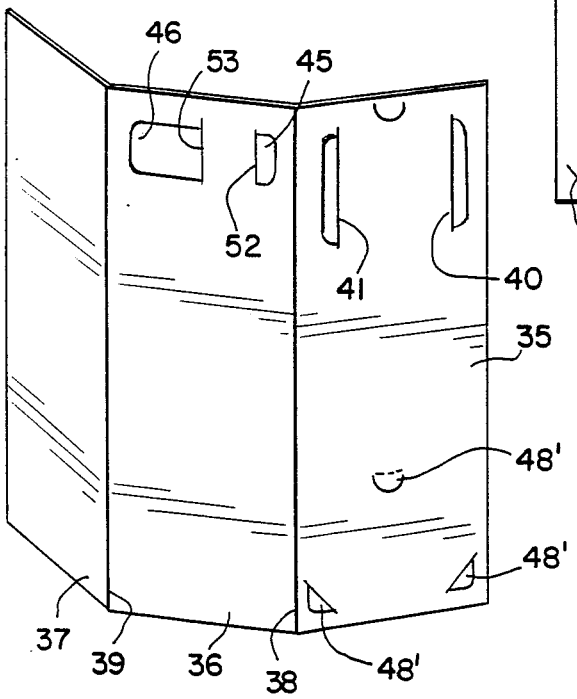
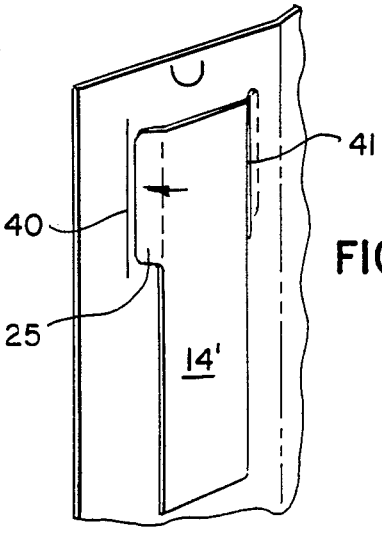
FIG. 7

AIRLINE LUGGAGE TAG AND JACKET THEREFOR AND METHOD OF USE

BACKGROUND AND SUMMARY OF INVENTION:

This invention relates to an airline luggage tag and jacket therefor and method of use and, more particularly, to a tag which is particularly adapted for computer printing, utilizing the new printers being purchased by most airlines.

The inventive tag constitutes an improvement on U.S. Pat. No. 4,631,845 which, as here, provides a separable check or stub but which requires pressure sensitive adhesive for affixing the ticket to the handle of the passenger's piece of luggage. The tag's pressure sensitive adhesive with its necessary release liner has caused jamming in the printers as well as being time consuming for installation about the handle of a passenger's luggage. Further, the prior art tag poses a waste disposal problem.

According to the present invention, the difficulties are overcome by virtue of providing arm portions on the tag which can be inserted into and cinched within slots provided in another portion of the tag. Moreover, the tag is advantageously and optionally provided with tear-off stubs for airport transfers. Other objects and advantages of the invention may be seen in the ensuing specification.

The invention is described in conjunction with an illustrative embodiment in the accompanying drawing, in which FIG. 1 is a top plan view of an embodiment of the inventive ticket;

FIG. 2 is an exploded top plan view showing the various parts separated;

FIG. 3 is a fragmentary perspective view showing the operation of the inventive tag;

FIG. 4 is a perspective view looking at the inside of a jacket embodying teachings of the invention;

FIG. 5 is a perspective view looking to the exterior of the jacket of FIG. 4;

FIG. 6 is a reduced scale plan view of the jacket of FIG. 4;

FIG. 7 is a fragmentary perspective view of the left hand portion of FIG. 4 showing an intermediate position of installing the baggage check in the receiving panel of the jacket; and FIG. 8 is a plan view of a ticket shown installed in the central panel of the perspective views of FIGS. 4 and 5.

DETAILED DESCRIPTION:

With reference to the drawing and particularly FIG. 1, the numeral 10 designates generally a paperboard blank which is provided either in separate or in a continuous, separable string, advantageously having dimension $9\frac{1}{2}'' \times 3\frac{3}{4}''$. The numerals 11 and 12 indicate two longitudinally extending lines of perforation while the numeral 13 designates a transverse line of perforation connecting the interior ends of the lines 11 and 12 at about 5" inward of the upper end of the blank 10. This results in a separable check 14.

After the check 14 has been separated as indicated at 11', 12' and 13' in FIG. 2, there remains a general U-shaped portion designated 15 and which includes a base 16 and arms 17, 18—see particularly FIG. 2.

The numerals 19 and 20 designate longitudinally extending slits each having punch-outs at the ends thereof to limit tearing—as at 21, 22 at one end and 23, 24 at the other end.

The lines of perforation 11, 12 are not straight throughout their entire length but offset as at 25, 26 to provide notch-like portions or ears 25, 26 to permit the check 14 to be inserted into a jacket as can be appreciated from a consideration of FIG. 7.

The numeral 27 designates a centrally longitudinally extending line of weakness in the base portion 16 and the numerals 28, 29 and 30 define separable tickets 31, 32 and 33.

OPERATION

With the illustrated embodiment, there are two forms readily available. With the line of weakness 27 being a line of perforation as indicated at 27' in FIG. 2, the U-shaped portion 15 is separable into two parts so as to accommodate two pieces of luggage. This is the form illustrated in FIG. 3. Where, however, the line of weakness 27 is a score line, the U-shaped portion can be folded on itself to provide, again, an L-shaped configuration and both arms 17, 18 inserted through the now-aligned slits 19, 20. This allows for information to be printed on one side of the blank 10 and read from either side after the L-shaped form is attached to the bag. This is advantageous if the tags are bar-coded and scanned enroute to final destination.

As indicated previously, the tags are provided either in separated form or in a separable continuous stream. The tag is printed by the airlines with information including passenger name, destination, flight information and transfer locations and codes. Other indicia may also be included.

The ticket agent then tears the blank 10 along the lines of perforation 11, 12 and 13 to free a claim check portion 14 of the tag which is then held in place when bent between two parallel slits die cut into a ticket jacket—see FIG. 7.

The remaining portion of the tag is then torn along the line of perforation 27 which separates the tag into two individual tags which can be used for two individual bags.

The individual tags are then wrapped around handles of the bags with the lower portion 16 being slipped through the slit 19 (see FIG. 3) capturing the baggage handle H in the now-formed loop.

The bag is then sent to the aircraft and, as the bag passes through connecting airports, the transfer tickets are torn off by airport personnel as indicated at P in FIG. 3.

The jacket referred to previously can be seen on the second drawing sheet and is generally designated by the numeral 34 in FIG. 4. The jacket 34 includes three relatively elongated panels 35, 36 and 37 which are separated by fold lines 38, 39. The panels 35 and 36 are functional in that they hold information pertinent to the particular passenger—the panel 37 being used for printed information applicable to all passengers. Each of the panels is $8\frac{1}{2}''$ long, the panels 35, 36 being 3 11/16" wide while the panel 37 is slightly narrower, providing an easily openable flap.

As indicated previously, a pair of spaced apart, parallel slits 40, 41 are provided for receipt of the baggage check 14. This can be seen in the left hand portion of FIG. 4 with the reverse face of panel 35 being seen at the right hand end of FIG. 5. FIG. 7 shows an intermediate stage of the installation of the baggage check, here designated 14'—into the slits 40, 41. More particularly, FIG. 7 shows how the baggage check 14' is longitudinally bent so as to align the ear 25 with the slit 40.

The central panel 36 provides a convenient location for mounting the ticket 42 which is seen in plan view in FIG. 8. The ticket 42 is equipped with an integral upper eared portion 43 which is separable from the ticket by virtue of a line of perforation 44 and with the lateral extending ears being designated 45 and 46. The bottom portion of the ticket designated 48 is separable along a line of perforation 47 and constitutes a boarding pass.

After the ticket 42 has been removed from its mounting on the panel 36, the boarding pass portion 48 is detached and given to the passenger for mounting on the panel 35 in the position designated 48'. For this purpose, triangularly related slits are provided as at 49, 50 and 51—see the lower left hand portion of FIG. 6. With larger boarding passes, the upper part may be inserted under the slit 49*a*.

Prior thereto, however, the ticket 42 is maintained in place by the ears 45, 46 through the provision of a longitudinally extending slit 52 and an L-shaped slit 53 as can be appreciated from a comparison of the central portions of FIGS. 4 and 5 with the central portion of FIG. 6.

The assembly described above provides a number of advantages, an important one of which is that jamming is avoided in the printers because there is no additional thickness in the baggage tag. Airlines have experienced the baggage tags assuming a "set" because of the pressure sensitive adhesive which results in jamming and therefore prolonged waiting at airline ticket counters. Further, there is the advantage of no waste requiring disposal by counter personnel. Advantageously, the back of the claim check can be printed to be used as a "limited release" form. Still further, the jacket provides an effective, convenient means for holding all of the information required by the passenger—both before boarding and after the ticket 42 has been separated into the portion retained by the airlines and the boarding pass retained by the passenger.

While in the foregoing specification a detailed description of the invention has been set down for the purpose of illustration, many variations in the details hereingiven may be made by those skilled in the art without departing from the spirit and scope of the invention.

I claim:

1. A luggage tag comprising an elongated paperboard blank, a pair of spaced apart longitudinally extending lines of perforation extending from one end and spaced apart a distance sufficient to provide a check portion adapted to carry passenger and flight information, a transverse line of perforation connecting said pair of lines of perforation to permit detachment of said check portion from said blank leaving a generally U-shaped portion with the base of said U-shaped portion being adjacent the other end of said blank and the arms of said U-shape flanking said check portion, a longitudinally extending slit in each arm, a centrally longitudinally extending line of weakness in said U-shaped base to permit the development of an L-shaped tag part including an arm and part of said base with the part of said base being installable into said slit to capture the handle of a piece of baggage.

2. The tag of claim 1 in which said line of weakness is a line of perforation for separating said U-shape into two handle-capturing tag parts.

3. The tag of claim 1 in which said line of weakness is a score line to permit folding of one L-shape over the other whereby identical flight information is available on both sides of said tag part.

4. The tag of claim 1 in which said base is equipped with at least one transverse line of perforation to develop separable transfer tickets.

5. The tag of claim 1 in which said slits each have a circular punched out portion at each end.

6. The tag of claim 1 in which said pair of lines of perforation diverging adjacent said base to provide mounting ears.

7. The tag of claim 6 in combination with a jacket, said jacket comprising a generally rectangular unitary paper sheet having at least two panels divided by a fold line, one of said panels having a pair of spaced apart slits extending parallel to said fold line, said ears being inserted into said slits.

8. The tag of claim 7 in which said one panel is equipped with further slit means to temporarily retain a boarding pass.

9. The tag of claim 7 in which a second of said panels is equipped with slit means adapted to removably receive ears of a passenger ticket.

10. A method of providing a luggage tag comprising advancing an elongated generally rectangular paperboard blank. through a computer printer to print passenger and flight indicia on a transversely central check portion of said blank extending longitudinally partway from one blank end and defined by lines of perforation arranged to form a generally U-shape, said blank transversely outward of said U-shape being equipped with longitudinally extending slit means, detaching said check portion and forming an L-shape with the remainder of said blank, and inserting the base of said L-shape through said slit means while capturing the handle of a piece of luggage.

11. The method of claim 10 in which said blank is equipped with a central, longitudinally-extending line of weakness longitudinally outward of said U-shape, and folding said blank on said line of weakness after said check portion has been detached and prior to insertion into said slit means.

12. The method of claim 10 in which said blank is equipped with a central, longitudinally-extending line of perforation longitudinally outward of said U-shape, separating said blank on said line of perforation after said check portion has been detached and prior to insertion into said slit means to provide two tags, and capturing the handles of two pieces of luggage with said tags.

13. The method of claim 10 in which said blank is equipped with a central, longitudinally extending line of perforation outward of said U-shape, tearing said blank along said central line of perforation to provide two baggage tag parts, and capturing the handles of two pieces of luggage with said tag parts.

14. The method of claim 10 in which said check portion is equipped with a pair of transversely extending ears, providing a jacket equipped with a pair of slit spaced apart a distance corresponding to the spacing between said ears, and inserting said ears into said slits.

* * * * *